United States Patent [19]

Harandi et al.

[11] Patent Number: 5,049,361

[45] Date of Patent: Sep. 17, 1991

[54] APPARATUS FOR FLUID-BED CATALYTIC REACTIONS

[75] Inventors: Mohsen N. Harandi, Lawrenceville; Hartley Owen, Belle Mead, both of N.J.

[73] Assignee: Mobil Oil Corp., Fairfax, Va.

[21] Appl. No.: 509,454

[22] Filed: Apr. 16, 1990

Related U.S. Application Data

[62] Division of Ser. No. 272,958, Nov. 18, 1988, Pat. No. 4,929,334.

[51] Int. Cl.[5] ..... B01J 8/18; F27B 15/16

[52] U.S. Cl. ..... 422/144; 34/57 A; 110/245; 122/4 D; 422/146

[58] Field of Search ..... 422/143, 144, 146; 34/57 A; 110/245; 122/4 D; 431/7, 170

[56] References Cited

U.S. PATENT DOCUMENTS 2,658,822 11/1953 Hengstebeck ..... 422/144

2,689,782 9/1954 Murphree ..... 422/146 X 2,944,963 7/1960 Wilson ..... 422/144 X 3,856,659 12/1974 Owen ..... 422/144 X

*Primary Examiner*—Robert J. Warden

*Assistant Examiner*—Amalia L. Santiago

*Attorney, Agent, or Firm*—Alexander J. McKillop; Charles J. Speciale; Robert B. Furr, Jr.

[57] ABSTRACT

An improved fluid-bed reaction apparatus is disclosed in which feedstock is preheated and may be at least partially converted by contacting the feedstock with spent catalyst in a preheat zone. Additional benefits include a reduction in catalyst poisons and coke production in the reaction zone. By contacting the fresh feed with hot spent catalyst, at least a portion of the coke which would otherwise form in the reactor is deposited on the spent catalyst. Temporary catalyst poisons are also sorbed onto the spent catalyst. The spent catalyst is then withdrawn from the preheat zone, stripped of entrained hydrocarbon and regenerated.

3 Claims, 2 Drawing Sheets

APPARATUS FOR FLUID-BED CATALYTIC REACTIONS

REFERENCE TO RELATED APPLICATIONS

This is a division of copending U.S. application Ser. No. 272,958, filed Nov. 18, 1988, now U.S. Pat. No. 4,929,334 issued May 29, 1990.

BACKGROUND OF THE INVENTION

Recent developments in catalyst technology have provided processes for the conversion of hydrocarbon feeds in fluidized catalyst beds at elevated temperatures. Such processes include dehydrogenation and aromatization. Central to the economic operation of these processes are sustained catalyst activity and efficient heat transfer.

Typical aromatization catalysts undergo both temporary and permanent loss of catalytic activity. Temporary loss of activity results from, among other factors, the accumulation of coke which blocks the catalyst pores. Both temporary and permanent loss of activity results from physical degradation or exposure to certain catalyst poisons. Temporary catalyst poisons include organic nitrogen compounds which deactivate the catalyst while they are present but are easily removed by oxidative regeneration.

In previous designs, essentially all process coke formed and was deposited on the catalyst in the aromatization zone, the very point in the process where maximum catalytic activity would be most advantageous. Thus, the aromatization process could be made more efficient, if a significant portion of coke production could be segregated from the aromatization reaction.

By blocking the catalyst pores, coke prevents the reactants from contacting the active sites of the catalyst. Coke appears to form from several different sources. A portion of the coke accumulation is attributable to thermal degradation of impurities and other easily cracked compounds in the feed. Additional coke is formed by catalytic cracking side reactions occurring concurrently with the aromatization reactions. Impurities in the feed such as oxygenates, of which glycol and furfural are examples, readily degrade to form coke upon contact with hot catalyst. To restore catalytic activity lost due to coke accumulation, the catalyst is oxidatively regenerated. During oxidative regeneration, coke burns off the catalyst as it is exposed to an oxygen-containing gas stream at elevated temperature, thereby restoring catalytic activity.

Unfortunately, however, the very process which remedies temporary deactivation causes a gradual permanent deactivation. As the catalyst is exposed to water, a regeneration by-product, at high catalyst regeneration temperatures, the crystalline structure undergoes a physical degradation commonly referred to as steam deactivation. The rate of steam deactivation is an integral function of temperature and water partial pressure. Thus, a reduction in the regeneration temperature while maintaining the desired regeneration combustion rate would be beneficial.

Heat transfer efficiency is a critical factor in the economic operation of a fluidized-bed aromatization process. Catalytic aromatization of paraffins is typically conducted at about 650° C. (1200° F.). Unfortunately, typical feeds can be heated in a process furnace to temperatures not greater than a few hundred degrees Farenheit lower than the aromatization or dehydrogenation temperature. At higher preheat temperatures, typical feeds crack to form coke on the heater tubes and transfer lines in addition to cracked products such as methane. The deposition of coke inside heater tubes and transfer lines can cause serious operational problems. On the other hand, the feedstock may easily be heated by direct contact with hot catalyst to temperatures about 50°-200° F. lower than aromatization reactor temperature without operational problems.

SUMMARY OF THE INVENTION

The process of the present invention shifts a significant portion of coke production away from the dehydrogenation/aromatization reaction zone, prolongs the active life of the catalyst, and preheats and partially upgrades the reactor feed. The process accomplishes these and other objects by contacting fresh feed with hot spent catalyst withdrawn from the dehydrogenation/aromatization reaction zone. While not presented to limit the invention by a recitation of theory, it is believed that preheating the fresh feed by direct contact with spent catalyst allows a major portion of the impurities in the feed such as oxygenates to react and form coke before they reach the dehydrogenation/aromatization reaction zone. The reaction of such impurities appears to be thermal degradation which does not require catalysis to proceed.

By contacting the fresh feed with hot spent catalyst, the impurities which would form coke in the aromatization zone are reacted and substantially removed in the preheat zone. Thus, the formation of coke is relocated to a feed preheat zone and a significant portion of the total coke formed during the aromatization reaction is merely deposited on the spent catalyst. Further, the fresh feed is at least partially upgraded due to the fact that the spent catalyst withdrawn from the reactor has the same average activity as the reactor catalyst inventory.

The hot spent catalyst is cooled as it contacts the fresh feed. By cooling the spent catalyst before it enters the regeneration zone, the present inventive process decreases heat input to the regeneration zone and confers another benefit: lower regeneration temperatures for a given rate of combustion. These lower regeneration temperatures decrease the rate of steam deactivation, prolong catalyst life, and may simplify the physical design of the regenerator by decreasing regenerator cooling requirements.

Finally, direct contact with hot spent catalyst preheats the aromatization reactor feed without causing significant thermal cracking. This serves to increase the yield of valuable aromatized products and to decrease the evolution of light $C_2$-gas.

It is an object of this invention to preheat and partially react a feedstock prior to its entry into a fluidized catalytic reaction zone.

It is a further object of this invention to reduce the degree of coke deposition occurring in the fluidized catalytic reaction zone.

It is still a further object of this invention to at least partially remove contaminants from the feedstock.

The invention achieves the above and other objects discussed in the specification by the steps of fluidizing a finely divided catalyst preferably in a sub-transport regime in a reaction zone, withdrawing spent catalyst from the reaction zone, contacting an aliphatic feedstream with the spent catalyst in a preheat zone whereby the aliphatic feedstream is preheated and may be partially converted, charging the preheated aliphatic feedstream to the reaction zone, withdrawing spent catalyst from the preheat zone, and stripping the catalyst of sorbed hydrocarbon.

DETAILED DESCRIPTION

Figure 1:
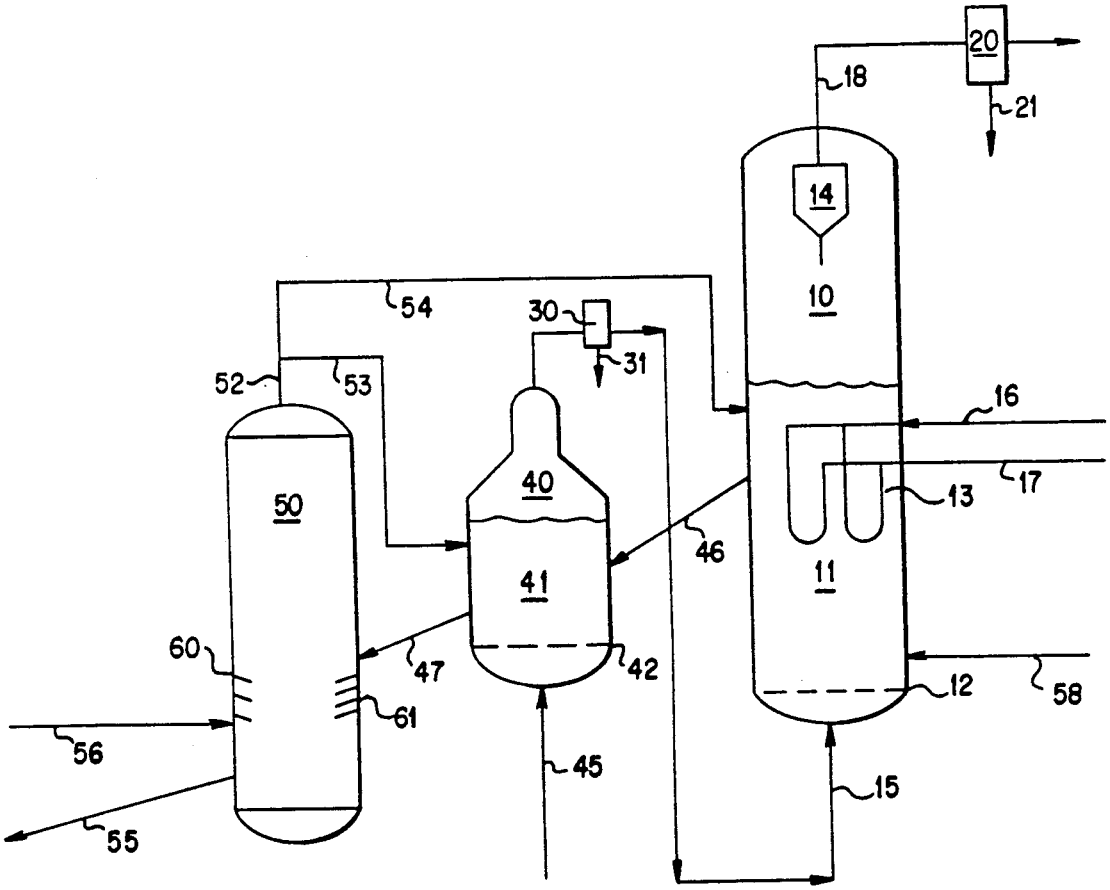
FIG. 1 shows a simplified schematic diagram of a first embodiment of the present invention in which the preheat zone and the catalyst stripping zone are located in separate vessels.

The present invention provides a process and apparatus for preheating feed to a fluidized-bed hydrocarbon conversion process by contacting the feed with hot spent catalyst. The invention provides a higher temperature feed to the fluidized-bed reactor while prolonging catalyst life. Depending on the preheat temperature, the feed may also be partially upgraded in the preheat zone.

Aromatization Process

Hydrocarbon upgrading reactions compatible with the process of the present invention include both the conversion of aliphatic hydrocarbons to aromatic hydrocarbons as well as the conversion of paraffinic hydrocarbons to olefinic hydrocarbons. Such conversions are discussed by N. Y. Chen and T. Y. Yan in their article "M2 Forming-A Process for Aromatization of Light Hydrocarbons", 25 IND. ENG. CHEM. PROCESS DES. DEV. 151 (1986), the text of which is incorporated herein by reference. The following representative U.S. patents detail the feed compositions and process conditions for the aromatization and dehydrogenation reactions. Aromatization and dehydrogenation process conditions are summarized in Table 1.

U.S. Pat. No. 3,756,942, incorporated by reference as if set forth at length herein, discloses a process for the preparation of aromatic compounds in high yields which involves contacting a particular feed consisting essentially of mixtures of paraffins and/or olefins, and/or naphthenes with a crystalline aluminosilicate, e.g. ZSM-5, under conditions of temperature and space velocity such that a significant portion of the feed is converted directly into aromatic compounds.

U.S. Pat. No. 3,759,821, incorporated by reference as if set forth at length herein, discloses a process for upgrading catalytically cracked gasoline.

U.S. Pat. No. 3,760,024, incorporated by reference as if set forth at length herein, teaches a process for the preparation of aromatic compounds involving contacting a feed consisting essentially of $C_2$–$C_4$ paraffins and/or olefins with a crystalline aluminosilicate, e.g. ZSM-5.

Hydrocarbon feedstocks which can be converted according to the present process include various refinery streams including coker gasoline, light FCC gasoline, $C_5$–$C_7$ fractions of straight run naphthas and pyrolysis gasoline, as well as raffinates from a hydrocarbon mixture which has had aromatics removed by a solvent extraction treatment. Examples of such solvent extraction treatments are described on pages 706–709 of the *Kirk-Othmer Encyclopedia of Chemical Technology*, Third Edition, Vol. 9, John Wiley and Sons, 1980. A particular hydrocarbon feedstock derived from such a solvent extraction treatment is a Udex raffinate. The paraffinic hydrocarbon feedstock suitable for use in the present process may comprise at least 75 percent by weight, e.g. at least 85 percent by weight, of paraffins having from 5 to 10 carbon atoms.

TABLE 1

| | |
|---|---|
| WHSV | Broad range: 0.3–500 $hr^{-1}$ |
| | Preferred range: 1–50 $hr^{-1}$ |
| OPERATING PRESSURE | Broad: 170–2170 kPa (10–300 psig) |
| | Preferred: 310–790 kPa (30–100 psig) |
| OPERATING TEMPERATURE | Broad: 540–820° C. (1000–1500° F.) |
| | Preferred: 560–620° C. (1050–1150° F.) |

Catalysts

The members of the class of zeolites useful in both dehydrogenation and aromatization reactions have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as if set forth at length herein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No.

4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Gallium-containing zeolite catalysts are particularly preferred for use in the present invention and are disclosed in U.S. Pat. No. 4,350,835 and U.S. Pat. No. 4,686,312, both of which are incorporated by reference as if set forth at length herein.

Zinc-containing zeolite catalysts are useful in the present invention, for example, U.S. Pat. Nos. 4,392,989 and 4,472,535, both of which are incorporated by reference as if set forth at length herein.

Catalysts such as ZSM-5 combined with a Group VIII metal described in U.S. Pat. No. 3,856,872, incorporated by reference as if set forth at length herein, are also useful in the present invention.

Dehydrogenation Catalysts

Paraffin dehydrogenation catalysts also include oxides and sulfides of Groups IVA, VA, VIA, VIIA and VIIIA and mixtures thereof on an inert support such as alumina or silica-alumina. Thus, dehydrogenation may be promoted by sulfides and oxides of titanium, zirconium, vanadium, mobium, tantalum, chromium, molybdenum, tungsten and mixtures thereof. Oxides of chromium alone or in conjunction with other catalytically active species have been shown to be particularly useful in dehydrogenation. Other catalytically active compounds include sulfides and oxides of manganese, iron, cobalt, rhodium, iridium, nickel, palladium, platinum and mixtures thereof.

The above-listed metals of Groups IVA, VA, VIA, VIIA and VIIIA may also be exchanged onto zeolites to provide a zeolite catalyst having dehydrogenation activity. Platinum has been found to be particularly useful for promoting dehydrogenation over zeolite catalysts.

Preheat Zone Operation

In a first embodiment of the present invention, a preheat zone is located in a preheater vessel; while in a second embodiment, the preheat zone is located in the upper section of a stripper/preheater vessel. Operating variables are essentially the same in both embodiments.

The feedstock is typically heated in a furnace or in a feed/effluent heat exchanger to a temperature approaching that at which coking can occur and is then charged to the preheat zone at a rate sufficient to maintain the spent catalyst in a state of sub-transport fluidization. This facilitates direct heat transfer between the feedstock and the spent catalyst and maintains the fluidized bed at an essentially uniform temperature. Consequently, the cooled spent catalyst and the preheated feedstock leave the preheat zone at approximately the same temperature. The exact operating temperature of the preheat zone depends on the catalyst circulation rate, the feedstock charge rate, the spent catalyst temperature at the preheat zone inlet and the feedstock temperature. Catalyst circulation ranges broadly between 0.1 and 100 total volumes of catalyst per hr., preferably between 0.5 and 5 total volumes of catalyst per hr. The spent catalyst temperature is essentially the same as the reaction zone temperature and ranges broadly between 480° and 820° C. (900° and 1500° F.), preferably between 560° and 620° C. (1050°-1150° F.). Heat from the spent catalyst is absorbed by the partial dehydrogenation or aromatization of the feed. The conversion achieved in the preheat zone depends strongly on catalyst circulation rate, spent catalyst temperature, preheat zone space velocity and feedstock composition. Typically the conversion is less than 25% by weight.

Fresh feed enters the preheat zone near the bottom and vaporizes upon contact with the hot spent catalyst. Materials which readily tend to form coke, such as oxygenates or heavy paraffins, react rapidly and are removed from the feedstream in the form of coke deposited on the spent catalyst. To maximize contact between the spent catalyst and the fresh feed, it is preferable to maintain fresh feed flowrate at a rate which will provide sufficient superficial gas velocity to fluidize the spent catalyst in a sub-transport regime. More preferably, the spent catalyst is maintained in a turbulent sub-transport regime to maximize contact between the feedstock and the spent catalyst. Formation of gas bubbles in catalyst beds fluidized in gas streams having lower superficial velocities than those required for a turbulent fluidization regime reduces contact between the catalyst particles and the fluidizing gas. While the process and apparatus of the invention are operational in a so-called bubbling bed regime, the advantages of feedstock partial conversion in the preheat zone, reduced coking in the reaction zone, and feedstock preheating are most fully realized by employing a turbulent fluidized-bed regime.

The process of the present invention may also be operated in a parallel/series configuration in which both fresh feed and preheated feed are charged to the reactor.

Stripping Zone Operation

The stripping zone is located in a stripper vessel in a first embodiment and occupies the lower section of a stripper-preheater vessel in a second embodiment. Baffles are installed in the stripping zone to increase catalyst/stripping gas contact time. The design and operation of a baffled stripper are taught by U.S. Pat. No. 3,728,239 to McDonald, incorporated by reference as if set forth at length herein.

A stripping gas is introduced into the stripper typically at a point above the stripped catalyst outlet and below the spent catalyst inlet line. The stripping gas is preferably both inert and essentially free of liquid water. Steam may be used but is not preferred due to the resultant steam deactivation caused by exposing the catalyst to water at high temperatures in the downstream catalyst regenerator.

DESCRIPTION OF THE FIRST EMBODIMENT

Referring now to FIG. 1, an aliphatic stream is charged through line 45 to a fluidized bed of spent catalyst 41 in the lower section of preheater 40 which is equipped with flow distributor 42. The aliphatic stream is preheated by direct contact with the spent catalyst to a temperature of between about 425° and 677° C. (800° and 1250° F.), typically around 538° C. (1000° F.) depending on the operating temperature of the aromatization reactor 10. As the aliphatic feed flows upward through the fluidized bed of spent catalyst 41, impurities in the feedstream which readily form coke thermally degrade and deposit additional coke on the spent catalyst. Additionally, temporary catalyst poisons such as nitrogen-containing compounds, are readily sorbed onto the spent catalyst.

Preheated feedstock is separated from entrained spent catalyst in one or more cyclone separators (not shown) positioned near the top of preheater 40. The preheated feedstock is then withdrawn from preheater 40 via line 15 which may optionally be equipped with an in-line sintered metal filter 30. Catalyst fines are removed from sintered metal filter 30 through line 31.

The preheated feedstream continues through line 15 and is charged to a fluidized bed of catalyst 11 in the lower section of reactor 10 which is equipped with distributor 12. The fluidized catalyst bed is heated by indirect exchange with a hot fluid circulating through heat exchanger 13 positioned inside the fluidized bed. The hot fluid is supplied to the heat exchanger through line 16 and is withdrawn through line 17, both of which lines extend through the shell of reactor 10.

As the aromatization reaction progresses, the catalyst becomes at least partially deactivated and is withdrawn from the fluidized bed 11 through conduit 46. The withdrawn catalyst is then charged to a fluidized bed of spent catalyst 41 in the lower section of preheater 40 as described above. The hot spent catalyst preheats the feedstream and is withdrawn from preheater 40 by line 47 and flows to stripper 50 which is equipped with baffles 60 and 61 (only two are designated).

A portion of the preheated feedstock is carried with the spent catalyst as it flows out of preheater 40. This feedstock is preferably removed before the catalyst is regenerated. In the regenerator, the feedstock burns to form carbon dioxide and water. Exposure to water at high temperatures causes permanent steam deactivation of the catalyst. This sorbed feedstock is stripped off the catalyst in stripper 50. A stripping gas enters stripper 50 near the bottom through line 56. Preferred stripping gases include inert gases, the most preferred of which is nitrogen. Stripping gas together with stripped hydrocarbon feedstock is withdrawn from stripper 50 through stripper overhead line 52 and charged either to preheater 40 through line 53 or directly to reactor 10 through line 54. Stripped spent catalyst flows from stripper 50 through line 55 to a regeneration unit, preferably a continuous regeneration unit, (not shown). Regenerated catalyst returns to reactor 10 from the regeneration unit through line 58.

DESCRIPTION OF THE SECOND EMBODIMENT

In a second embodiment of the present invention, spent catalyst preheats the feedstock and is then stripped as in the first embodiment. The second embodiment differs from the first, however, in that the second embodiment employs a single stripper/preheater vessel rather than separate vessels as in the first embodiment. Operation of the reactor 10 is identical to that of the first embodiment.

Figure 2:
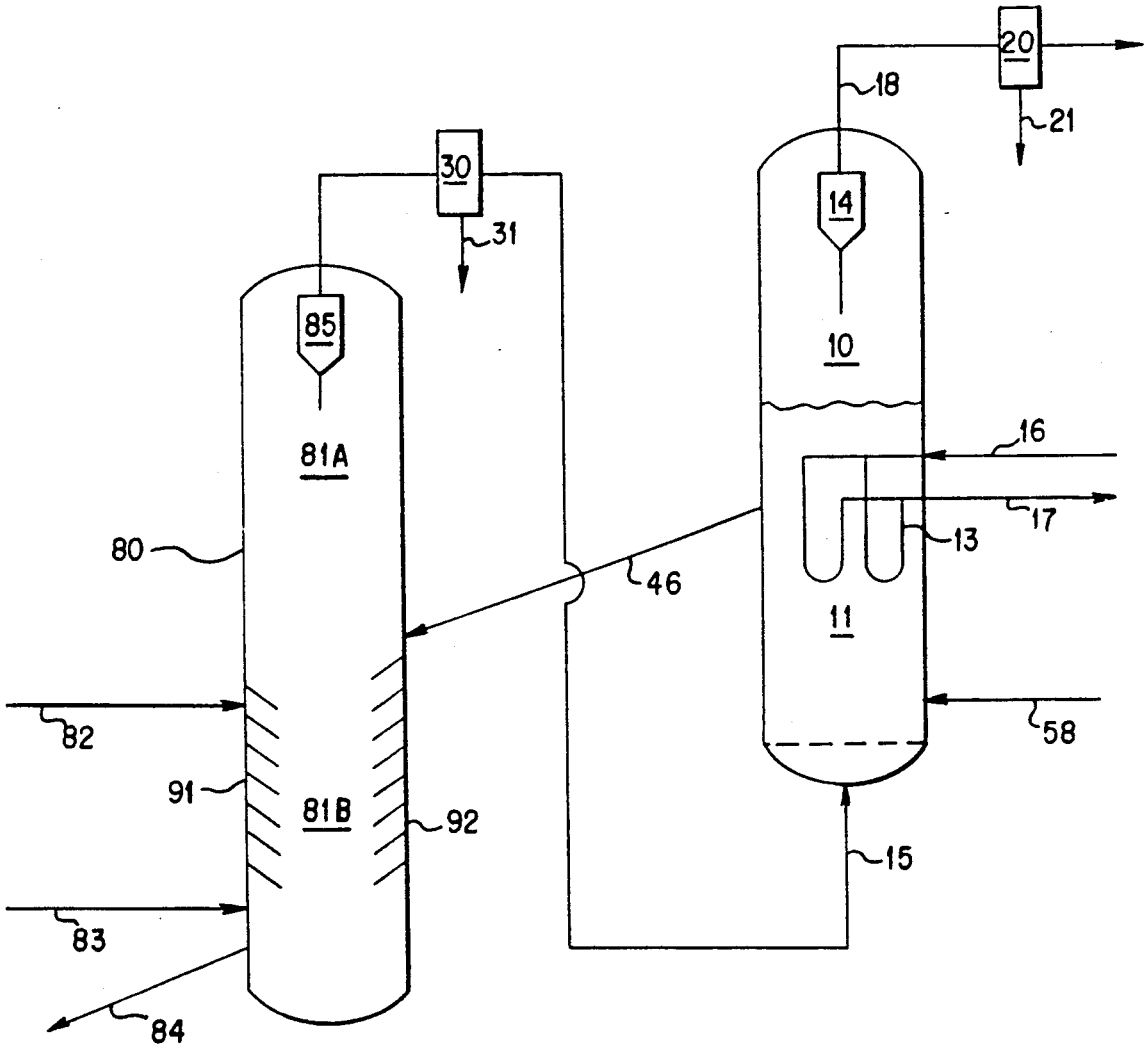
FIG. 2 shows a simplified schematic diagram of a second embodiment of the present invention in which the preheat zone and the catalyst stripping zone are located in a single vessel.

Referring now to FIG. 2, spent catalyst is withdrawn from reactor 10 through line 46 and charged to stripper/preheater 80 at a point near the top of the stripping zone 81B. Preheat zone 81A is located in the stripper/-preheater vessel above stripping zone 81B. The catalyst flows generally downward and contacts feedstock flowing into stripper/preheater 80 through line 82. The feedstock flows upward through preheater section 81A in contact with fluidized spent catalyst, is separated from the spent catalyst in cyclone separator 85, and is withdrawn from stripper/preheater 80 by line 15. One or more cyclone separators may be positioned near the top of stripper/preheater 80 and line 15 may optionally be equipped with one or more sintered metal filters 30. It is to be understood that in both the first and second embodiments, sintered metal filters may be used alone without cyclone separators.

Spent catalyst flows downward through stripping section 81B which is fitted with baffles 91 and 92 (only two are designated), while stripping gas flows upward, injected into the stripping zone through line 83. Stripped spent catalyst flows out of stripper section 81B through line 84 to a continuous regeneration unit (not shown). Regenerated catalyst is returned from the continuous regeneration unit to reactor 10 via line 58. The regeneration unit is preferably a continuous regeneration unit.

Changes and modifications in the specifically described embodiments can be carried out without departing from the scope of the invention which is intended to be limited only by the scope of the appended claims.

What is claimed is:

1. An apparatus for the conversion of hydrocarbons comprising:

(a) a reactor vessel for containing a fluid bed reaction zone including finely divided catalyst, said reactor vessel further comprising a feed distributor positioned in a lower portion of said reactor vessel, a heat exchange conduit within said reactor vessel in direct contact with said fluid bed reaction zone for transferring heat from a hot circulating fluid to said fluid bed reaction zone, and a catalyst separator positioned in an upper section of said reactor vessel for segregating reaction products from entrained spent catalyst;

(b) a first conduit for withdrawing spent catalyst from said fluid bed reaction zone;

(c) a feed preheater vessel operatively connected to said first conduit (b) for contacting an aliphatic feedstream with a fluidized bed of said spent catalyst, said feed preheater vessel being sized to provide spent catalyst circulation through said preheater vessel of from about 0.1 to about 100 volumes of spent catalyst per hour, said spent catalyst circulation affording sufficient contact time between said aliphatic feedstream and said spent catalyst to preheat said aliphatic feedstream and to convert at least a portion of the coke precursors in the aliphatic feedstream to coke, whereby said spent catalyst is cooled and coke is deposited on said spent catalyst;

(d) a second conduit for charging said aliphatic feedstream to a lower section of said feed preheater vessel;

(e) a third conduit for transferring said preheated aliphatic feedstream from an upper portion of said feed preheater vessel to a lower portion of said reactor vessel;

(f) a catalyst stripper vessel for countercurrently contacting said cooled spent catalyst with a stripping gas to desorb hydrocarbons from said cooled spent catalyst;

(g) a fourth conduit for charging said stripping gas to a lower section of said catalyst stripper; and (h) a fifth conduit for transferring a hydrocarbon enriched stripping gas from said catalyst stripper to said reactor vessel.

2. The apparatus of claim 1 further comprising a sixth conduit for transferring said hydrocarbon enriched stripping gas from said catalyst stripper vessel to said feed preheater vessel.

3. The apparatus of claim 1 wherein said third conduit contains a sintered metal filter for separating entrained catalyst from said preheated aliphatic feedstream.

* * * * *